US007413075B2

(12) United States Patent
David et al.

(10) Patent No.: US 7,413,075 B2
(45) Date of Patent: Aug. 19, 2008

(54) STAND-ALONE PACKAGING FOR TUBES

(75) Inventors: Alexandre David, Rouen (FR); Reto Egli, Lucerne (CH); Sandra Grandhaye, Les Damps (FR)

(73) Assignee: Johnson & Johnson Consumer Companies, Inc., Skillman, NJ (US)

( * ) Notice: Subject to any disclaimer, the term of this patent is extended or adjusted under 35 U.S.C. 154(b) by 320 days.

(21) Appl. No.: 10/516,673

(22) PCT Filed: May 27, 2003

(86) PCT No.: PCT/EP03/05719

§ 371 (c)(1),
(2), (4) Date: Oct. 20, 2005

(87) PCT Pub. No.: WO03/099677

PCT Pub. Date: Dec. 4, 2003

(65) Prior Publication Data

US 2006/0124495 A1 Jun. 15, 2006

(30) Foreign Application Priority Data

May 27, 2002 (EP) ..... 02291282

(51) Int. Cl.
*B65D 85/14* (2006.01)

(52) U.S. Cl. ..... 206/277; 206/446; 206/763; 206/765

(58) Field of Classification Search ..... 206/277, 206/446, 756, 763, 764, 765, 465, 477, 386, 206/490, 476, 461, 486
See application file for complete search history.

(56) References Cited

U.S. PATENT DOCUMENTS 3,847,282 A * 11/1974 Collura et al. ..... 206/782
3,887,067 A * 6/1975 Collura et al. ..... 206/780
4,128,168 A * 12/1978 Roccaforte ..... 206/783
6,015,043 A * 1/2000 Sandberg et al. ..... 206/446

* cited by examiner

*Primary Examiner*—David T Fidei

(57) ABSTRACT

A stand-alone packaging (1) for tubes (14) of different shapes and sizes being placed in the packaging (1) having a back wall (2) and a front wall (3), which are linked at a top side (4), a bottom wall (5) and a platform surface (6), which is linked to the back wall (2) and the front wall (3), the back wall (2), at its bottom side, has a tab (8) that fits into an opening (9) at a fold between the bottom side of an interior front wall (15) and the bottom wall (5), the platform surface (6) is connected to the bottom wall (5) by the interior front wall (15) which becomes visible when opening the back wall (2), the platform surface (6) has a flap (11) linking the platform surface (6) to the front wall (3), the platform surface (6) is parallel to the bottom wall (5) and has an opening (7) in which the tube (14) fits, wherein the tube (14) is placed upside down in the packaging (1) with the tube (14) fitting narrowly into the opening (7) of the platform surface (6), and the portion at which the tube (14) is sealed being placed at the top side (4), a fold (17) is provided between the top side (4) and the back wall (2), such that the back wall (2) is hinged to the top side (4) of the packaging (1) and can be opened so as to remove the tube (14).

11 Claims, 10 Drawing Sheets

STAND-ALONE PACKAGING FOR TUBES

CROSS-FEFERENCE TO RELATED APPLICATIONS

This application is the national stage filing under 371 of international application Ser. No. PCT/EP03/05719 filed on May 27, 2003.

BRIEF DESCRIPTION OF THE INVENTION

This invention relates to a stand-alone packaging for tubes.

BACKGROUND OF THE INVENTION

Consumer products for skin care are contained in an appropriate primary packaging, such as a bottle, a plastic container, or a tube. This primary packaging in turn is usually packed into a secondary packaging, the function of which is to protect the product inside and to provide a means of presenting the product to the public. The most frequently used secondary packaging is a cardboard box in which the primary packed product is placed.

The presentation of the product to the consumer is important in that it allows conveying certain information about the product and helps the consumer to make her or his choice to purchase the product. Stand-alone packages offer particular advantages in this regard in that they can easily be placed on the shelf, counter or other spots where the product is presented to the public.

Various types of secondary packagings have been disclosed in the prior art. For example, DE 91 08 595 U discloses a packaging that has a back wall and a front wall, which are linked at a top side, a bottom wall and a platform surface, which is linked to the back wall and the front wall, the back wall, at its bottom side, has a tab that fits into an opening at a fold between the bottom side of an interior front wall and the bottom wall, the platform surface is connected to the bottom wall by the interior front wall which becomes visible when opening the back wall, the platform surface has a flap linking the platform surface to the front wall by gluing, the platform surface is parallel to the bottom wall and has an opening in which the tube fits.

U.S. Pat. No. 1,367,174 describes a confection-cone carrier consisting of a rectangular cardboard or paper blank. A plurality of perforations each of which having a diameter corresponding to that of a cone are provided adjacent the right-hand end of the blank. Adjacent the perforations the blank is slit to provide a pair of first tabs, which extend in the direction of the perforations. The blank is slit intermediate its ends to provide another pair of second tabs which extend in the direction opposite to said first tabs. Adjacent said second tabs the blank is formed with a pair of oval openings which are designed for the reception of a person's finger so that the portion of the blank between two openings provides a handle for carrying the carrier as a unit. The blank is bent to provide a bottom, a front wall, a supporting partition, a lip, a rear wall and a cover. The lip extends downwardly and engages the second tabs whereby the supporting partition is supported in horizontal position and in spaced parallel relation with the bottom to support the cones within said perforations. The cover is extended over the partition with its free end secured against and in overlapping relation to the front wall by means of third tabs and said first tabs. The third tabs are inserted into the openings provided by the first tabs such that the upward displacement of the cover from the front wall is prevented.

WO 02 20367 A discloses a carton for holding one or more articles like flexible pouches and comprises an article retaining structure for preventing the dislodging of the packaged articles through the open ends of the carton. A retaining panel extends between the carton side walls intermediate the top and bottom walls of the carton to form a tubular structure in cooperation with the top wall. The retaining panel is formed with at least one article receiving aperture. Tubular structure is provided with a brace for retaining the tubular structure in an erected form.

U.S. Pat. No. 3,692,228 shows a unit dose device having a base extending between a back and a front. The base is connected to the back at a first fold and to the front at a second fold. A support, having a hole, extends between the back and the front. The support is connected to the front at a third fold. A top is pivotally connected to the back at a fourth fold. The top is movable to cover the support. Means are provided for fixing the support to the back between the first and fourth folds. Means are also provided for removably securing the top in a position overlying the support and spaced apart therefrom.

DE 91 14 139 U is related to a package, particularly for batteries, having a back side and a structure being mounted to a lower region of the back. Said backside forms also a back side section in the upper region of said structure and extends from the upper wall to a lower wall of the structure. A fold is provided at the lower end of the backside and is part of the lower wall of the structure. The lower wall has another fold defining a section line between the lower wall and a stiffened front wall section of the structure being positioned rectangularly to the lower wall. The stiffened front wall is spaced in a parallel position to the back side which space corresponds to the size of the cross-section of the batteries. The stiffened front wall has a fold opposite to the lower wall of the structure. This fold defines a connecting line between the stiffened front wall and a skirt for the batteries. Said skirt is positioned at a right angle to the back side of the package. Also, the skirt has a fold at the opposite side of the stiffened front wall, which skirt forms a section line between the skirt and a back wall of the structure wherein the back side is positioned at a right angle to the skirt and parallel to the backside of the package. The structure of the package has a front wall being spaced parallel to the back side. Said front wall has a plunging latch at its lower end associated to the lower wall of the structure which latch is introducible in to a slot in the lower wall being positioned in the midst of the fold forming the connecting line between the lower wall and front wall. The front wall has a window, whilst the back side has an opening to suspend the package.

U.S. Pat. No. 6,015,043 discloses a folded bottle display packaging of which a top portion of the bottle is covered by a cap. A window is sized so as to allow the top portion of the bottle to protrude through a plane formed by a front wall of the package. A top flap is left in the window extending along the same plane as top portion over the window. Said top flap secures the bottle in position. A wrap-around portion creates a tent-like package with open sides to view the bottle through the side of the package.

FR 2 513 867 A is related to a package, particularly for tubes. A rectangular section forms a tongue and two openings and has several folding lines. One end of said section is folded onto itself and attached by adhesive so as to form a prismatic tube. Said tube defines a base to form a back wall adjacent to two openings for the tubes. An opposite end of the section is folded to the front side. The tongue extends from the tube to its other end and is connected to the other folded end by adhesive. The tubes are immobilized between the openings in the prismatic tube receiving them and the upper end being folded to the front side.

DE 42 18 290 A shows a package for a tube consisting of a longitudinal section having at least two folding regions to form a base and two leg portions which are folded so as to form a tube-like structure having a triangular cross section and one-piece upper portion which is formed by both of said legs being connected to one another by adhesive and has an opening in its upper part to suspend said package. One leg has a cut-out portion a part of which is folded into the space provided by the triangular cross-section of said tubular base and has an opening corresponding to the cross-section of the sealed portion of the tube as to form a support for the tube above said base of the triangular tube. The upper end of the tube is held by a latch being cut out from the other leg in the upper vertical section commonly formed by said two legs being connected to one another.

U.S. Pat. No. 3,847,282 discloses an open-end display carton for collapsible tubes formed from a cut and scored blank. It comprises a rectangular base panel having a first end structure foldably connected at one end thereof for supporting an end of said tube. The other end of the base panel has a second end structure foldably connected thereto and supporting the opposite end of the tube, both of the structures having abutments located at fold lines thereof for location and support of the ends of the tube. A first closing panel is foldably connected to the first end structure and a second closing panel is foldably connected to the second end structure. The second closing panel extends over the base panel in spaced relationship thereto and is secured to the first closing panel.

DE 297 02 982 U describes a sales packaging for small containers which package has a front wall, a back wall and a bottom, wherein the front wall has an opening, the contour of which is smaller than the contour of the small container. The contour of the opening in the bottom and cover of the container projects into the contour of the container. The package is made from a rectangular strip having embossments for folding which divide said strip in sections that form the front wall, the back wall, the bottom and a securing latch. A slot is provided between the bottom and the securing latch as to receive an insertion latch at the opposite end of said strip. Another section of the strip connected to the back wall covers the front wall in the folded condition of the package.

One type of packagings for tubes are small completely closed cartons or cardboard boxes in which the tube narrowly fits. Although this type of packaging offers good product protection and is easy to handle, it is somewhat disadvantageous in terms of presentation to the consumer: this type of packaging is not particularly well suited for presentation as a stand-alone packaging nor for hanging. Nor can the consumer readily inspect the tube packed in this type of box. Another type of packaging comprises a cardboard platform covered by a transparent film that narrowly encloses the tube. Although this may be a visually attractive product presentation, it has the disadvantage of being unconvenient for opening and once opened, the packaging is destroyed.

Another problem associated with closed cardboard box packages is that they do not allow the consumer to visually inspect the product that is packed inside. Making openings in the packaging usually results in reduced strength causing the packaging to become unattractive and also to provide inadequate protection to the product packed therein.

Hence there is a need for secondary packagings for tubes that allow a stand-alone presentation of the product, and, by preference, can also be hung. There is an additional need for secondary packagings that allow an attractive presentation of the product packed therein and that allow an easy removal of the product. There is a further need to provide a secondary packaging for tubes that allow the consumer to see and visually inspect the product while having sufficient strength to adequately protect the product packed therein. Additionally, there is a need for secondary packagings that can be stacked compactly in cardboard boxes used for transportation of the products in the distribution chain from manufacturer to user.

SUMMARY OF THE INVENTION

The present invention is meant to address these needs by providing a new stand-alone packaging for tubes, having the particular features described in claim 1. Subclaims 2 to disclose further useful embodiments and improvements.

Accordingly, this invention concerns a stand-alone packaging for tubes or similar products of different shapes and sizes being placed in the packaging. The stand-alone packaging has a back wall and front wall, which are linked together at a topside. It further has a bottom wall and a platform surface, which is linked to the back wall and the front wall. The back wall, at its bottom side, has a tab that fits into an opening at a fold between the bottom side of an interior front wall and the bottom wall. The platform surface is connected to the bottom wall by the interior front wall, which becomes visible when opening the back wall. The platform surface has a flap linking the platform surface to the front wall, preferably by gluing. The platform surface is parallel to the bottom wall and has an opening in which the tube fits.

The stand-alone packaging of the invention is further characterized in that the tube is placed upside down in the packaging and the portion at which the tube is sealed is placed at the tip side. Preferably, the portion of the tube that fits narrowly into the opening of the platform surface is the cap portion of the tube. The platform surface has one or more grooves providing extra strength to the platform surface. Preferably the grooves run in parallel and more preferably, the platform surface has two grooves, each positioned at another side of the opening in the platform surface and still more preferably, each groove runs from the front to the back wall portion of the platform surface, both grooves running in parallel. In particular embodiments, the top side of the packaging in itself is a plane and is formed by linking of the top sections of the back wall and the front wall. In other particular embodiments, a fold is provided between the top side and the back wall. The back wall is hinged to the top side of the packaging and can be opened so as to remove the tube. The back wall may optionally have an opening at the fold between the top side and the back wall, or the said fold may have one or more slits or cuts. The top side preferably has a pack board opening at the top. Preferably, the bottom wall and the platform surface are of equal size.

Finally, the invention is also related to a strip of material, which can be transformed into a stand-alone packaging as above-mentioned, wherein the strip is linked together at two spots, one at the top, the other at the spot at the front wall where the platform surface is linked to it.

Of particular preference are the embodiments of the present invention having one or more of the particular, preferred or specific features mentioned throughout this specification and claims.

DETAILED DESCRIPTION OF THE INVENTION

The invention will be explained in detail with reference to the accompanying drawings.

Figure 5:
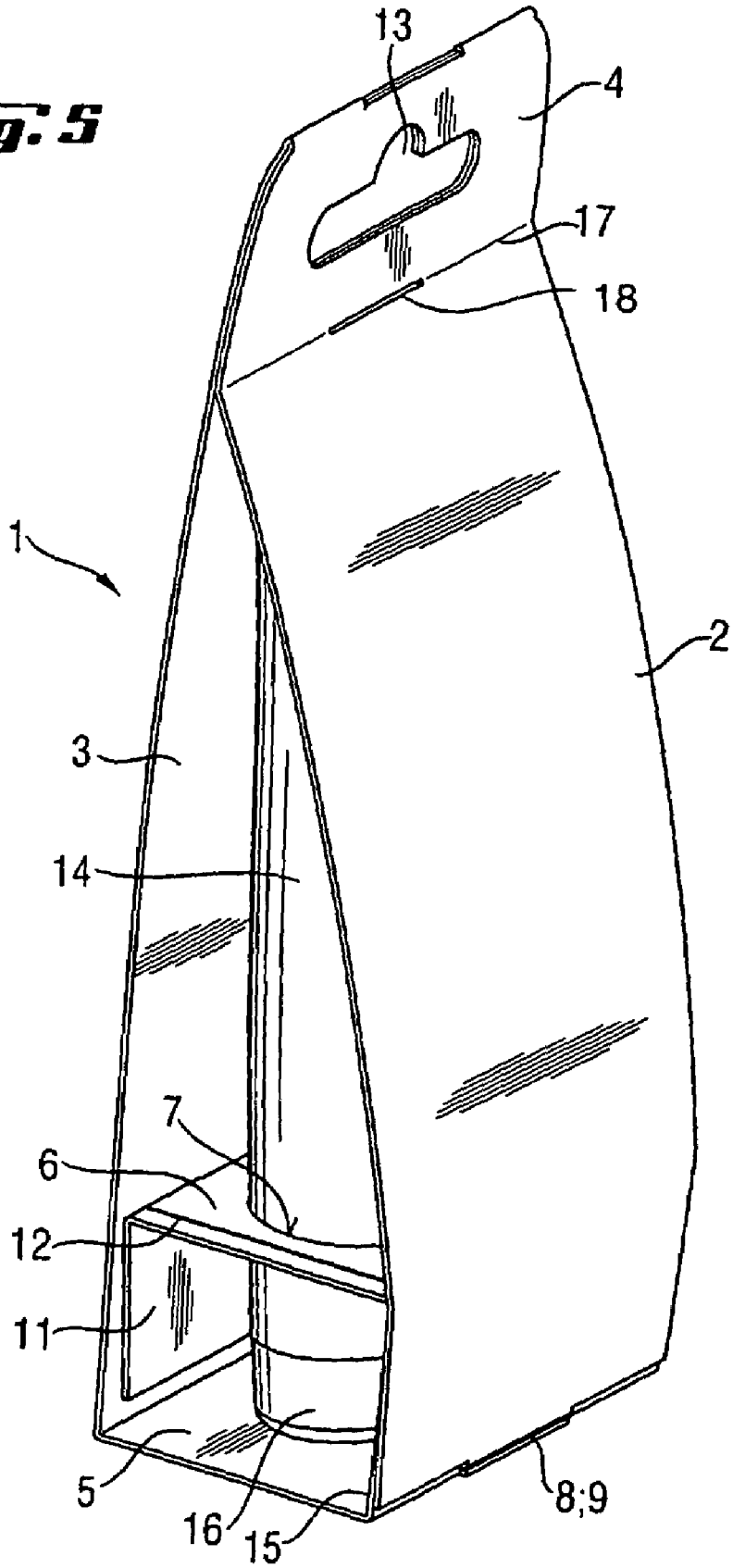
FIG. 5 is a perspective view of another embodiment of a stand-alone packaging according to the present invention.

This invention concerns a stand-alone packaging 1 for tubes 14 as shown in FIG. 5 or similar products. It has a back wall 2 and a front wall 3, which are linked together at a top side 4. It further has a bottom wall 5 and a platform surface 6, which is linked to the back wall 2 and the front wall 3. This platform surface 6 is parallel to the bottom wall 5 and has an opening 7 in which a tube narrowly fits. The platform surface 6 is connected by the bottom wall 5 to an interior front wall 15, which becomes visible when opening the back wall 2.

In certain embodiments, the top side 4 in itself may be a plane or in other embodiments it can be just a fold 17 between the front wall 3 and the back wall 2. In the embodiments where the top side is a plan in itself, the fold 17 may be at the back wall 2, or at the front wall 3 or at both walls 2 and 3. Preferably, fold 17 is only at the back wall 2 and no fold 17 is present at the front wall. In certain embodiments fold 17 is provided with one or more narrow slits or cuts 18, preferably with one narrow slit or cut 18 in the middle of fold 17. This may be done to ease opening of back wall 2 by reducing the resistance of the hinging fold 17.

In certain embodiments, the fold between the interior front wall 15 and platform surface 6 may be provided with one or more narrow slits or cuts 19, preferably with one narrow slit or cut 19 in the middle of said fold. This may be done to ease folding of the material of which the packaging is made when creating the fold between wall 15 and platform 6.

The packaging 1 optionally has a pack board opening 13 at the top. The pack board opening 13 conveniently is located at the top side 4, preferably in the middle of the plane of top side 4.

The back wall 2 is hinged to the top side 4 of the packaging and can be opened so as to remove the product inside. The back wall 2 has a closing means, which links the bottom portion of the back wall 2 to the interior front wall 15.

In certain embodiments, the back wall 2, at its bottom side, has a tab 8 that fits into an opening 9 at the fold between the bottom side of the interior front wall 15, and bottom side 5.

In particular embodiments of the invention, the platform surface 6 may have one or more grooves 12, which provide extra strength to the platform surface 6. In further particular embodiments platform surface 6 has two grooves 12, preferably one at each side of opening 7. Preferably, said grooves 12 run in parallel from the back wall 2 to the front wall 3.

Preferably, the tube 14 is placed in the packaging in such way that the upper part of the tube, i.e. the part of the tube that is sealed, touches the top part of the inner part of the packaging, i.e. there where the front wall 3 and the back wall 2 touch each other.

The back wall 2 or the front wall 3 may optionally have an opening 10 in which the sealed part of the tube 14 fits. Preferably opening 10 is at the back wall 2, more in particular at the fold 17 between back wall 2 and top side 4. In preferred embodiments, opening 10 is in the middle of fold 17. Opening 10 may be used to provide extra support to the tube, which is advantageous with narrower tubes. Opening 10 most advantageously is present in those packagings that are for packing round tubes.

In an embodiment of the invention, the opening 10 is at the top of the back wall 2, in particular at the fold 17 between the top section 4 and the back wall 2.

The package can be made out of one strip of material, which is linked together at two spots, one at the top, the other at a spot at the front wall where the platform surface 6 is linked to it. The platform surface 6 therefore has a flap 11 whose purpose is to link the platform surface 6 to the back wall 2.

The invention further relates to strips of material, which can be transformed into a stand-alone packaging as defined herein.

Figure 1:
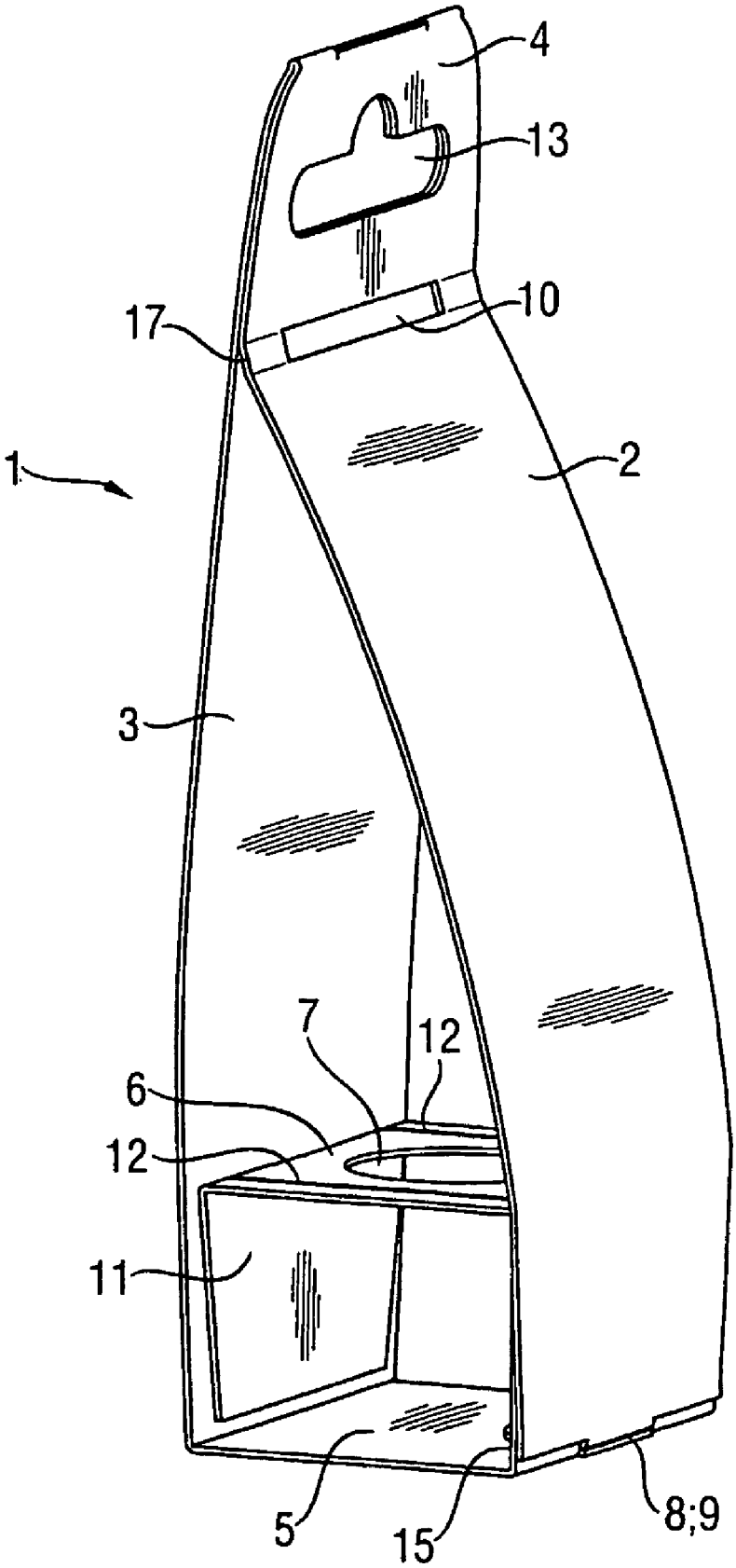
FIG. 1 is a perspective view of one embodiment of a stand-alone packaging according to the present invention.

FIG. 1 shows the stand-alone package 1 according to the invention with the closed back wall 2. The latter and the front wall 3 are linked together at the bottom of the top section 4. The top section 4 may optionally have the pack board opening 13.

Figure 2:
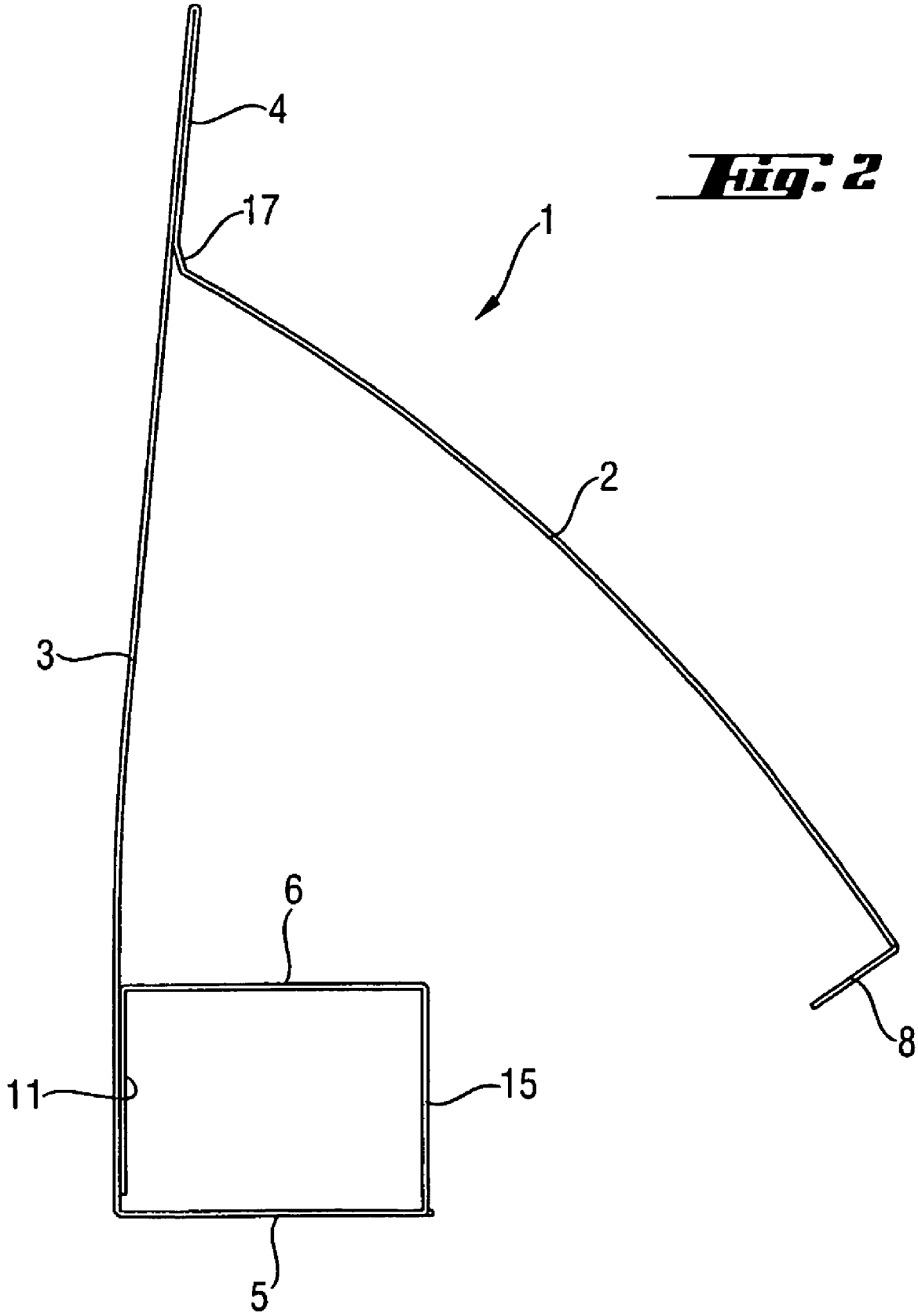
FIG. 2 is a side view of the embodiment of FIG. 1, with opened back panel.
Figure 3:
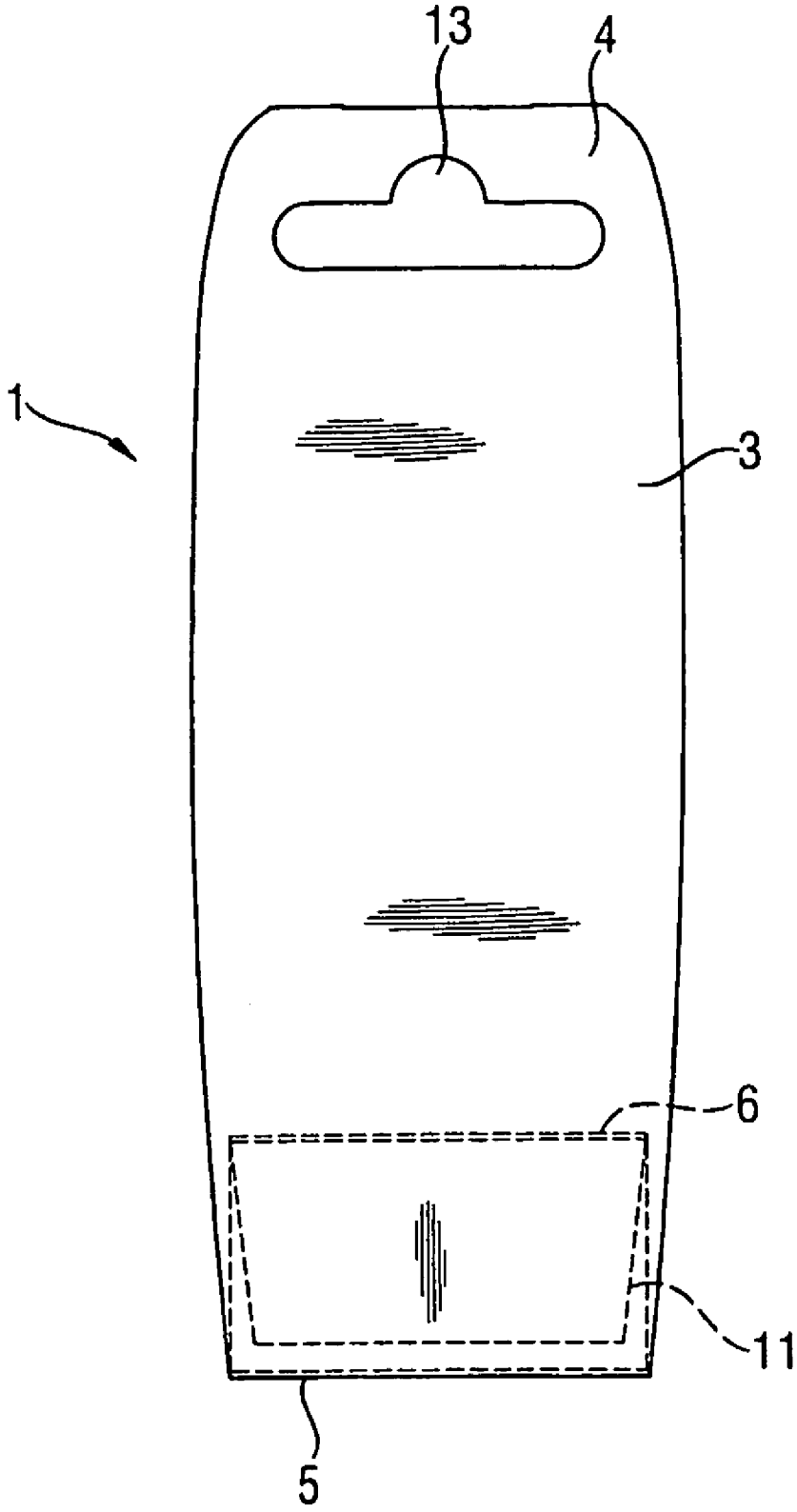
FIG. 3 is a front view of the embodiment of FIG. 1.
Figure 4:
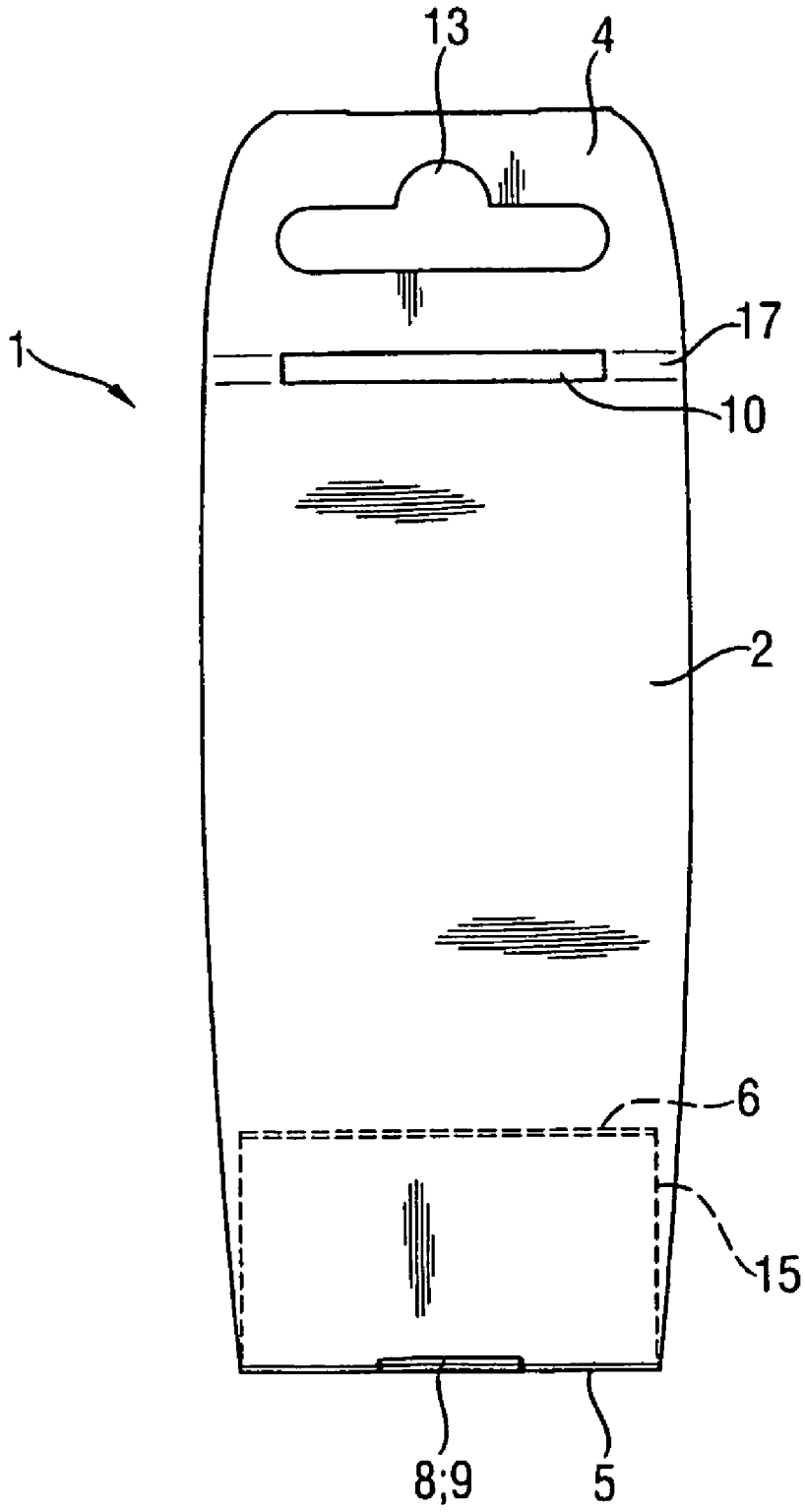
FIG. 4 is a back view of the embodiment of FIG. 1.

More details can be seen from FIGS. 2, 3 and 4.

FIG. 5 shows an alternative embodiment of the stand-alone packaging of the invention in which the sides of the front wall 3 and the back wall 2 are curved, which provides an elegant presentation of the packaging 1. In the embodiment represented in FIG. 5, the curving is such that the top portion of the front wall 3 and the back wall 2 is wider than the bottom portion 5. This type of packaging may be advantageous to pack tubes 14, which are more flatly shaped (having a cross-section which an ellipse, a flattened ellipse or the like) which tubes usually are broader at the side where the tube is sealed, i.e. opposite to the side of a cap 16.

Figure 6:
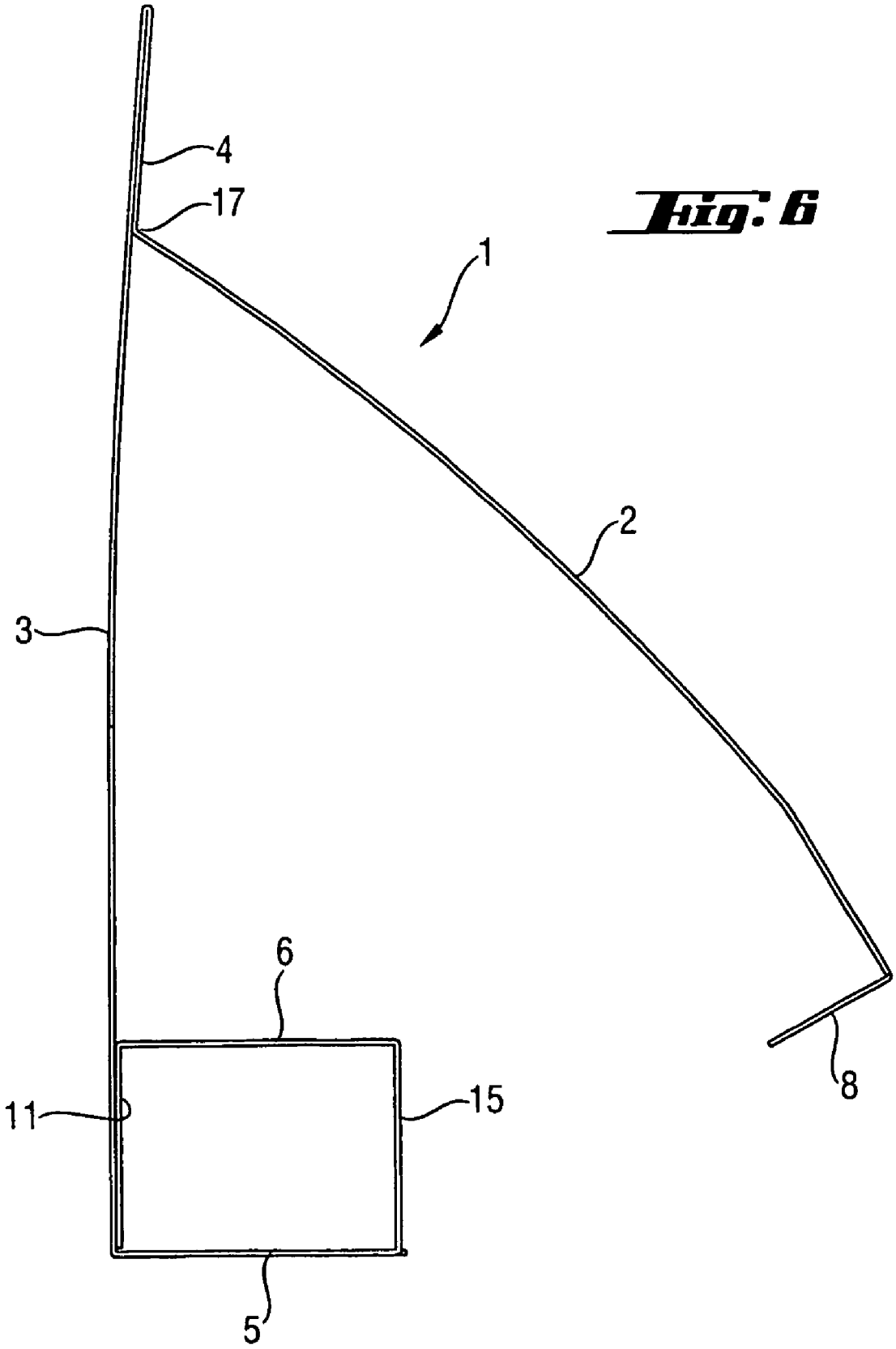
FIG. 6 is a side view of the embodiment of FIG. 5 without tube.
Figure 7:
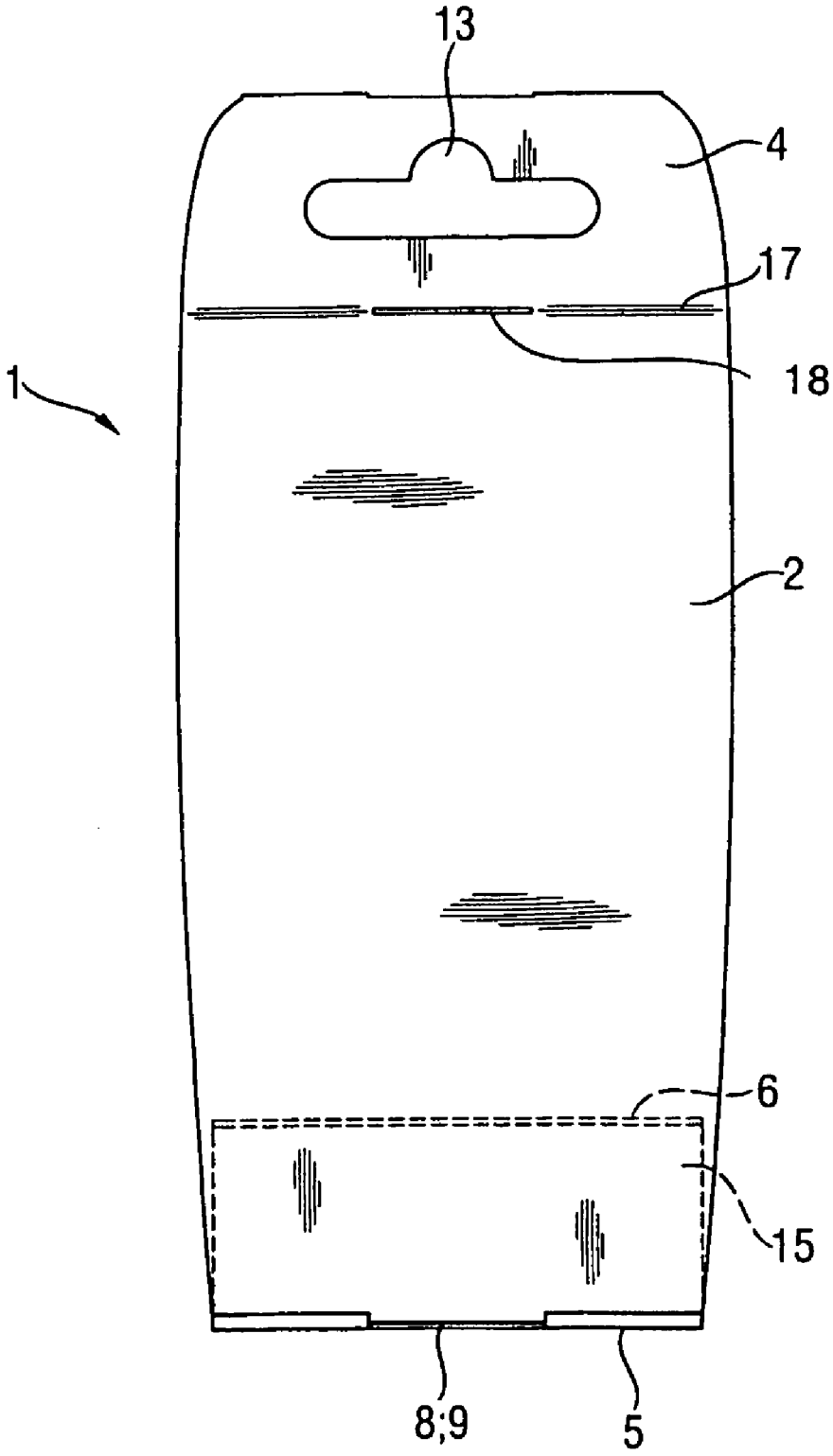
FIG. 7 is a back view of the embodiment of FIG. 5.

More details can be seen in FIGS. 6 and 7.

Figure 8:
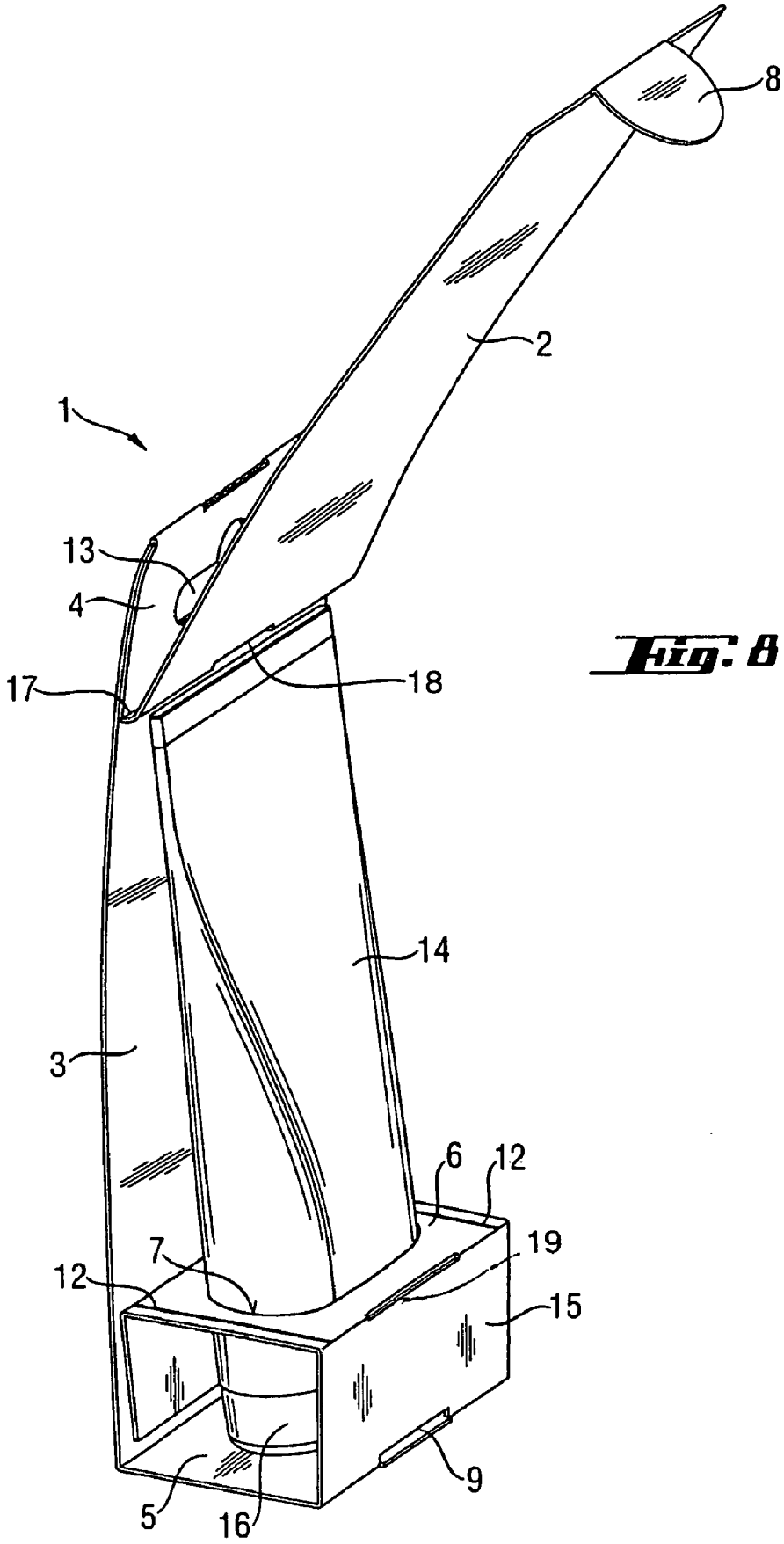
FIG. 8 is a perspective view of the embodiment of FIG. 5 with a tube and an opened back wall.

FIG. 8 shows a perspective view of the embodiment of FIG. 5 with the opened back wall 3 in which the tube 14 is present. The tab 8 fits in the opening 9.

Figure 9:
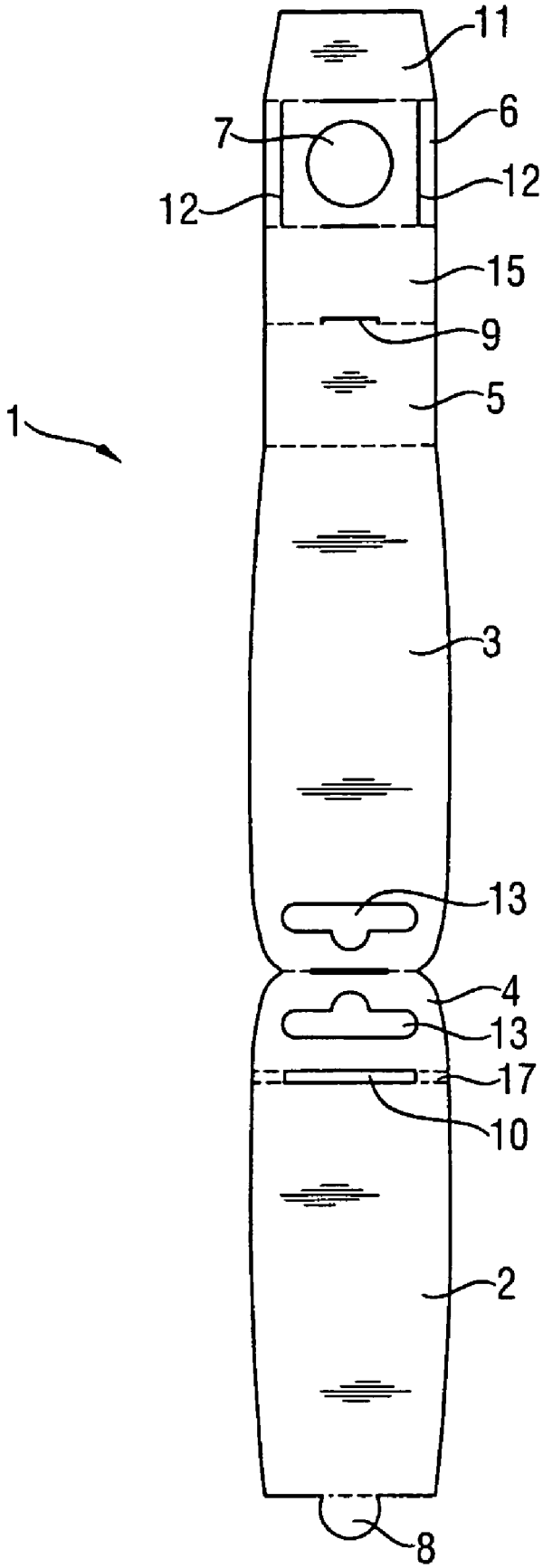
FIG. 9 shows a strip of material used for making the embodiment of FIG. 1.

FIG. 9 shows a strip of material of which the embodiment of FIG. 1 is made. The interrupted lines in the figures refer to the pre-folds. At these spots, the strip will be folded. The flap 11 will be glued to the back wall 2. The two interior sides of the top side 4 will be glued together. The grooves 12 provide extra strength to the packaging.

Figure 10:
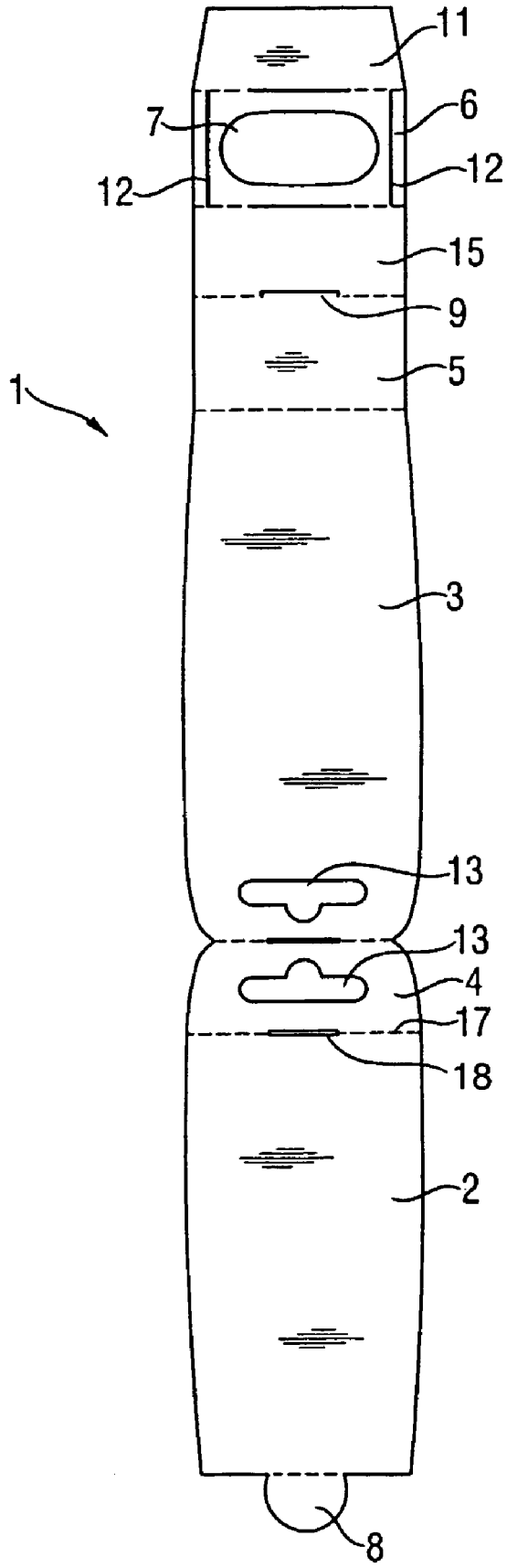
FIG. 10 shows a strip of material used for making the embodiment of FIG. 5.

FIG. 10 shows a strip of material of which the embodiment of FIG. 5 is made.

The stand-alone packaging 1 according to the present invention is meant to contain tubes 14 of different shapes and sizes. The shape of the tubes 14 can be cylindrical, or close to cylindrical, i.e. having a cross-section, which is a circle or close to a circle. The tubes 14 can also take other forms, i.e. a flattened form, i.e. having a cross-section, which is an ellipse or close to an ellipse, e.g. a flattened ellipse, or a square or rectangle, or close to a square or rectangle, e.g. a square or rectangle with rounded edges.

The tubes 14 are placed upside down in the packaging, i.e. with the part of the tube 14 having the cap 16 at the bottom side 5 of the packaging 1, and the portion at which the tube 14 is sealed at the top side 4. The tubes 14 can be long or short, i.e. the ratio between length and width may vary. Preferably, the cap portion of the tube is held in the opening 7.

The shape of the tube 14 will impact the shape of the opening 7 in the platform surface 6 in that this shape is adapted to the shape of the tube 14 held therein. The opening 7 has the same or about the same shape and size as the cross-section of the tube 14 held therein. The dimensions of the stand-alone packaging 1 according to the invention are in relation to the tube 14 packed therein, e.g. longer tubes 14 require a higher front wall 3 and higher back wall 2.

The tubes 14 can be made of any material used in the art, e.g. plastic, metal, mono- or multi-layered. The products contained in the tubes 14 may be any material known in the art to be packed in tubes. It can be personal care products, such as creams, jellies, pastes (e.g. tooth pastes). Examples of creams are moisturizing, anti-aging, sunscreen and the like creams. Other materials that can be packed in the tubes 14 are food products, glues and other connecting materials, paints, filler materials and the like.

The material from which the packaging 1 of the invention is made can be any material suitable for making secondary packagings. Preferably the package 1 is made of cardboard. The cardboard can be mono- or multi-layered or can be covered by a layer or coating from another material such as plastic or metal. It can be printed or coated, or both, partially or over its complete surface.

As mentioned above, several of the dimensions of the packaging 1 of this invention are determined by the dimensions of the tube 14 packed therein, examples of such dimensions being the size of opening 7, the length of the front and the back walls 3 and 2. Other dimensions can be chosen, e.g. the width of the front and the back walls 3 and 2, the dimensions of the bottom surfaces 5 and 6 and the same of the top side 4. Also the shape of some of these surfaces may vary. In one embodiment all surfaces are squares or rectangles but in other embodiments the sides of the back and front wall 2 and 3 can be rounded.

In alternative embodiments, the back wall and the front wall may be provided with one or more openings. In particular, the back wall 2 and the front wall 3 may optionally be provided with one or more openings allowing further means to visualize the tube 14 packed in the packaging 1. In order not to loose too much strength, these openings shall preferably be not too big or too many. If desired, e.g. to make the product more attractive, these openings in the back wall 2 or in the front wall 3 may be furnished with a transparent film.

The bottom wall 5 and the platform surface 6 are parallel planes. They can be of different or, which is preferred, of equal size.

In further alternative embodiments, the back wall and the front wall may have an additional fold where those walls hit the platform surface so that a section of the back wall and the front wall form a separate wall between the bottom surface and the platform surface. Said separate wall may run in parallel where the bottom wall and the platform surface are equally sized planes. In particular, the back wall 2 and the front wall 3 may have an additional fold where those walls hit the platform surface 6 so that a section of the back wall 2 and the front wall 3 between the bottom surface 5 and the platform surface 6 form a separate wall, which may run in parallel where the bottom surface 5 and the platform surface 6 are equally sized planes.

In one type of embodiments, the top side 4 is formed by linking together the extensions of the back wall 2 and the front wall 3. The linking can be done by standard means, e.g. by gluing the two sides of the top section 4 together.

The top side 4 may be of different sizes or shapes. Its size should be such that it provides sufficient surface to allow adequate linkage of the top sections 4 of the back wall 2 and the bottom wall 5. In one embodiment it is just a fold between the back wall 2 and the bottom wall 5. In embodiments not requiring the pack board opening 13, the top side 4 may be relatively small. In embodiments requiring the pack board opening 13 the top side 4 may be a bigger plane and should at least be big enough to allow an adequate positioning of the opening 13.

The packaging 1 preferably has a pack board opening 13 at the top. In certain embodiments, the opening 13 is located in the top section 4, e.g. in about the middle of the plane forming the top section 4. The opening 13 may have different shapes adapted for hanging on a suitable hanging means. One particular shape is rectangular, with rounded edges, with a small round-shaped recess at the top middle part in which the hanger fits.

The flap 11 is linked to the back wall 2 so that the platform surface 6 is held in place. This linking is also done by standard means, e.g. by gluing the flap 11 to the front wall 3.

The stand-alone packaging 1 of this invention has sufficient strength to adequately protect the tube 14 packed therein. Additionally, the tube 14 packed inside is visible to the consumer from the side of the packaging, which is open. The packaging 1 can easily be opened and closed in order to remove the tube 14 and place it back into packaging 1.

The packaging 1 according to the invention further allows an attractive presentation of the tube 14 packed therein. The packaging 1 can be labeled, e.g. at its front 3 or back walls 2, by adhering appropriate labels or by printing or coating, or a combination of these.

Another advantage is that the packages 1 can be compactly stacked in cardboard boxes.

The packaging 1 of this invention can be presented as a stand-alone product but in case it is furnished with the pack board opening 13 it can also be presented on hangers.

The packaging of the invention can easily be manufactured by simple and low cost procedures, with limited waste of raw material. Compared to standard packagings 1 for tubes 14 which are completely closed cardboard boxes the total amount of needed raw material for manufacturing the packagings 1 of the present invention is less.

An additional feature of the packagings 1 of the present invention is that they easily allow the front 3 and back wall 2 to be broader, giving the packaging 1 a larger facing, the latter referring to the side of the product that is visible to the consumer. This allows for more visibility of the information that can be put on the front 3 or back wall 2 such as trademarks, drawings, color patterns, informative text and the like.

The packaging 1 according to the invention is made out of one strip of material that is provided with grooves for folding. One or more of the grooves for folding may be provide with one or more slits or cuts for easy folding. Preferably, one or more of the folds is provide with a slit or cut positioned in the middle of the fold. Subsequently the strip is folded and the front and the back side of the top portion 4 are linked together as well as the flap 11 to the front wall 3. The linking may be done by an appropriate glue.

The invention further relates to strips of material, which can be transformed into the stand-alone packaging 1 as defined herein. In one embodiment said strip comprises the back section 2, the top side section 4, the front side section 3, the bottom section 5, the small front section 15, the platform surface section 6 and the flap 11.

REFERENCE NUMBERS

1 stand-alone package
2 back wall
3 front wall
4 top side
5 bottom side
6 platform surface

7 opening
8 tab
9 opening
10 opening
11 flap
12 groove
13 opening
14 tube
15 small front section
16 cap
17 fold
18 cut or slit
19 cut or slit

The invention claimed is:

1. A stand-alone packaging for tubes of different shapes and sizes being placed in the packaging having a back wall and a front wall, which are linked at a top side, a bottom wall and a platform surface, which is linked to the back wall and the front wall, the back wall, at its bottom side, has a tab that fits into an opening at a fold between the bottom side of an interior front wall and the bottom wall, the platform surface is connected to the bottom wall by the interior front wall which becomes visible when opening the back wall the platform surface has a flap linking the platform surface to the front wall, the platform surface is parallel to the bottom wall and has an opening in which the tube fits, wherein the tube is placed upside down in the packaging with the tube fitting narrowly into the opening of the platform surface, and the portion at which the tube is sealed being placed at the top side, a fold is provided between the top side and the back wall, such that the back wall is hinged to the top side of the packaging and can be opened so as to remove the tube.

2. A packaging according to claim 1 wherein the top side in itself is a plane and is formed by linking of the top sections of the back wall and the front wall.

3. A packaging according to claims 1 or 2 wherein a fold is provided between the top side and the back wall and no fold is provided at front wall.

4. A packaging according to claim 2 wherein the top side has a pack board opening at the top.

5. A packaging according to claim 1 wherein the bottom and the platform surface are of equal size.

6. A packaging according to claim 1 wherein the platform surface has grooves providing extra strength to the platform surface.

7. A packaging according to claim 5 wherein the platform surface has two grooves, one at each side of the opening 7, said grooves running from the back wall to the front wall.

8. A packaging according to claim 1 wherein the cap of the tube fits narrowly into the opening.

9. A packaging according to claim 1 wherein the back wall or the front wall are provided with an opening at a fold between the top side and the back wall or the front wall (3).

10. A packaging according to claim 1 wherein the linkages are obtained by gluing.

11. A strip of material, which can be transformed into a stand-alone packaging as claimed in claim 1, wherein the strip is linked together at two spots, one at the top, the other at the spot at the front wall where the platform surface is linked to it.

* * * * *